United States Patent [19]

Salovaara

[11] Patent Number: 4,780,184

[45] Date of Patent: Oct. 25, 1988

[54] METHOD FOR THE ADJUSTMENT OF THE DEWATERING IN THE WIRE SECTION OF A PAPER MACHINE

[75] Inventor: M. Juhani Salovaara, Kuusankoski, Finland

[73] Assignee: Tamfelt Oy Ab, Finland

[21] Appl. No.: 921,494

[22] Filed: Oct. 22, 1986

[30] Foreign Application Priority Data

Oct. 22, 1985 [FI] Finland ..... 854121

[51] Int. Cl.[4] ..... D21F 1/00

[52] U.S. Cl. ..... 162/208; 162/211; 162/217; 162/349; 162/363

[58] Field of Search ..... 162/208, 211, 209, 210, 162/308, 312, 313, 314, 351, 348, 349, 217, 352, 374, 363

[56] References Cited

U.S. PATENT DOCUMENTS

| | | | |
|---|---|---|---|
| 1,577,897 | 3/1926 | Daninger | 162/351 |
| 2,392,150 | 1/1946 | Hornbostel et al. | 162/348 |
| 3,000,439 | 9/1961 | Moore | 162/314 |
| 3,470,063 | 9/1969 | Sanford | 162/301 |
| 3,876,500 | 4/1975 | Csordas et al. | 162/300 |
| 3,922,190 | 11/1975 | Cavan | 162/374 |
| 4,152,249 | 3/1979 | Hansen | 162/210 |
| 4,214,949 | 7/1980 | Schiel et al. | 162/372 |
| 4,306,934 | 12/1981 | Seppanen | 162/211 |

FOREIGN PATENT DOCUMENTS

| | | | |
|---|---|---|---|
| 41-5812 | 3/1966 | Japan | 162/348 |

*Primary Examiner*—Kenneth M. Schor
*Assistant Examiner*—K. M. Hastings
*Attorney, Agent, or Firm*—Lowe, Price, Leblanc, Becker & Shur

[57] ABSTRACT

A method and apparatus are provided for the adjustment of the dewatering in the wire section of a paper machine. A fiber web is fed on to a forming wire, and the forming wire is passed over the surface of at least one dewatering means and a partial vacuum dependent on the difference in the speeds of the wire and said surface is created under the forming wire. An additional movable wire is positioned to move between the forming wire and the dewatering means and the dewatering is adjusted according to the kind of the fibre web to be dewatered, by adjusting the speed of the additional wire independently of the speed of the forming wire.

4 Claims, 1 Drawing Sheet

FIG. 1
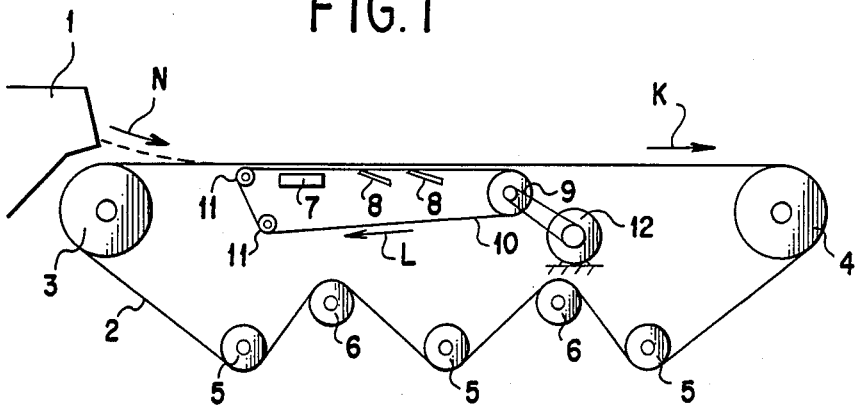
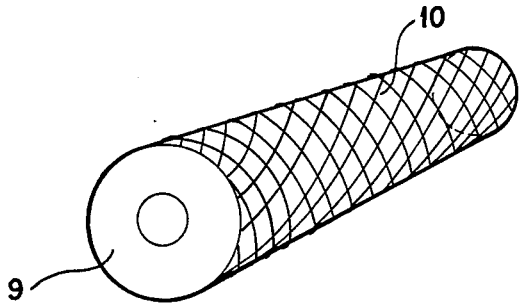
FIG. 2

METHOD FOR THE ADJUSTMENT OF THE DEWATERING IN THE WIRE SECTION OF A PAPER MACHINE

FIELD OF THE INVENTION

This invention relates to a method and apparatus for the adjustment of dewatering in the wire section of a paper machine and, more particularly a method and apparatus for passing a fiber-web on forming wire over the surface of at least one dewatering means so that a partial vacuum effecting the dewatering is created under the forming wire.

BACKGROUND OF THE INVENTION

It has long been known in the paper-making industries to make the dewatering of a fiber web led from the head box of a paper machine on to a forming wire, more efficient by various dewatering means. Examples of such dewatering means are suction boxes, drainage foils, and suction rolls. These dewatering means are positioned under the forming wire so that the wire moves over the surface of the dewatering means.

Also, it is also known in paper technology that suction rolls and drainage foils rotating at the same speed as the wire create on trailing side thereof a partial vacuum which is proportional to the square of the speed of the wire moving over the dewatering means. The resulting suction effect is utilized for dewatering a fiber web within the wire section of the paper machine.

In suction boxes widely used in paper machines, the suction which removes water from the fibre web is determined by the choice or the adjustment of a suction pump or a fan. In order to prevent wearing of the forming wire due to the suction effect, a wear wire or band is often inserted between the forming wire and the suction box, which wear wire or band moves at the same speed as the forming wire.

A disadvantage of this is that it is rather difficult to thus create a different partial vacuum for different kinds of fiber webs. It has been suggested previously that for example the fan of the suction box should be adjusted. However, this kind of adjustment is difficult to carry out, because a manual adjustment requires a high professional skill from the person carrying out the adjustment, and an instrumental adjustment, in turn, is complicated and therefore expensive and, further, requires regular service. It has also been suggested previously that the partial vacuum created by the foil should be adjusted by varying the angle at which it is positioned with respect to the wire. This adjustment, too, is difficult to carry out, and it has not, either, provided the best possible result because the foils are easily deformed, e.g., when they get worn or dirty, so that the original adjustments set for a new foil do not provide the desired result.

DISCLOSURE OF THE INVENTION

The principal object of the invention is to provide a method and a device by means of which the above disadvantages can be obviated.

An object of the method according to this invention is to ensure that the partial vacuum effecting the dewatering is easily adjustable, such that the adjustment is rapidly carried out without changing the speed of the forming wire. A related further object of the method of this invention is to make it available for improvements in connection with paper machines already in use. In addition, another object of this invention is to provide apparatus for adjustably dewatering a forming wire in a paper-making machine that is simple and inexpensive in use as that the need for service is insignificant, and the services can be to a great extent carried out in connection with the other services of the paper machine.

These and other related objects of the method of this invention are realized in the dewatering in the wire section of a paper machine by passing the forming wire thereof over the surface of at least one dewatering means so that a partial vacuum to effect the dewatering is created thereby under the forming wire such that the partial vacuum is dependent on a speed difference between the forming wire and the dewatering means surface, adjustment of the dewatering being obtained by providing an additional moving wire, located between the forming wire and the surface of the dewatering means, such that adjustment of the speed of the additional wire independently of the speed of the forming wire causes adjustment of the partial vacuum and hence the dewatering.

The same and other related objects of this invention are realized by providing an apparatus for the adjustment of dewatering in the wire section of a paper machine, in which a fiber web is fed onto a forming wire moved by moving means over the surface of at least one dewatering means to create a partial vacuum under the forming wire for the dewatering in a manner related to the difference in speed between the moving wire and the dewatering surface, wherein the desired dewatering adjustment is obtained by providing an additional wire positioned to be movable between the forming wire and a surface of the dewatering means and means for adjusting the speed of the additional wire independent of the means for moving the forming wire. In another aspect of the invention, the additional wire forms a sleeve around a suction roll.

The invention will be described in more detail in the following with reference to a preferred embodiment thereof as shown in the attached drawing.

BRIEF DESCRIPTION OF THE DRAWING

FIG. 1 is a side elevation view of a paper machine, with a device according to the invention used within said wire section.

FIG. 2 is a perspective view of a suction roll provided with a wire in the form of a sleeve therearound.

DESCRIPTION OF THE PREFERRED EMBODIMENTS

With respect to FIG. 1, in a typical paper machine a fiber web is fed from a head box 1 onto a forming wire 2, as indicated by the arrow N. The forming wire 2 forms an endless loop around a plurality of rolls e.g., 3, 4, 5 and 6. The direction of motion of the forming wire 2 is indicated by means of the arrow K in the figure. The motion of the forming wire 2 is effected by means of a driven roll e.g., roll 3 or 4. These matters are believed to be obvious to one skilled in the art, so they are not more closely discussed here.

Dewatering means, e.g., a suction box 7, drainage foils 8, and a suction roll 9, are positioned under the forming wire 2. The structure and the operation of said means belong to the prior art and are believed to be obvious to one skilled in the art, so they too are not more closely discussed here.

In apparatus according to this invention additional wire or the like 10 is provided between the forming wire 2 and the dewatering means 7, 8 and 9. The term "wire of the like" here means a wire, a band, a mat or some other means having the desired properties. In the example of FIGS. 1 and 2, the additional wire or the like 10 forms an endless loop which is fitted around the suction roll 9 and guide rolls 11. The additional wire or the like 10 is rotated in the direction shown by the arrow L by means of the suction roll 9, which is provided with driving means 12 for moving additional wire 10 at a selected speed.

According to the invention, the speed of the additional wire or the like 10 is adjusted independently of the speed of the forming wire 2. This adjustment is based on the idea that by suitably adjusting the speed of the additional wire or the like 10, driven by a drive means, e.g., 12, independent of the means driving the forming wire, such as either roll 3 or 4, a desired partial vacuum can be created on the trailing side of the drainage foils 8 or on the trailing side of the suction roll 9, even though the forming wire 2 moves at a different speed of its own. The speed of the forming wire 2 may be, e.g. 1000 m/min, and the speed of the additional wire 10 or the like may be 500 m/min, whereby the desired partial vacuum effecting the dewatering of the fibre web is created at said points. When the nature of the fiber web is changed, the dewatering conditions to be provided may become different. Thus the speed of the forming wire 2 may still be the same 1000 m/min, whereas the speed of the additional wire or the like 10 may be adjusted say to a value 300 m/min. By means of such adjustment, the suction effect obtained is adjusted to be the most advantageous one for the fiber web in question. In practice, the speed adjustment of the additional wire or the like 10 can be effected extremely simply by providing the driving means 12 of the suction roll 9 with means of known kind for the adjustment of the speed of rotation of the suction roll 9.

The above example is by no means intended to restrict to invention, which can be modified within the scope of the claims in various ways. Accordingly, the device according to the invention or the parts thereof do not need to be exactly similar to those shown in the figures, but other kind of solutions are possible as well. For instance, the additional wire or the like 10 does not need to be a loop, as shown in FIG. 1, but an equally possible solution is that the additional wire or the like 10 forms a sleeve around the suction roll 9 as shown in FIG. 2. The adjustment of the dewatering is thereby effected in the same manner as described above, i.e., by adjusting the speed of rotation of the suction roll so that the partial vacuum created on the trailing side of the suction roll varies as described above. The number of the devices according to the invention likewise is not restricted and there can be several such devices provided one after another, if required. Nor is the number of the dewatering means 7, 8, 9 restricted as this can be chosen to meet the requirements in each particular case. The means used for the adjustment of the speed of rotation of the suction roll can, of course, be any conventional means.

What is claimed is:

1. A method for adjustment of dewatering in a wire section of a paper machine, comprising the steps of:

feeding a fiber web onto a forming wire moved over at least one dewatering means;

passing the forming wire over the surface of said at least one dewatering means so that a partial vacuum effecting the dewatering is thereby created under the forming wire, the partial vacuum being dependent on the relative speed between the forming wire and said surface;

providing an additional moving wire whose path of travel passes between the forming wire and the surface of said dewatering means, said additional moving wire being provided such that it moves relative to the forming wire and said surface of the dewatering means; and adjusting the speed of the additional wire independently of the speed of the forming wire such that the speed of the additional moving wire is different from the speed of the forming wire and such that the partial vacuum and hence the dewatering is thereby adjusted.

2. The method according to claim 1, wherein said passing and providing steps comprise:

passing both the forming wire and the additional wire over at least one suction box, which functions as said dewatering means, to thereby obtain a portion of the dewatering.

3. The method according to claim 1, wherein said passing and providing steps comprise:

passing both the forming wire and the additional wire over at least one foil, which functions as said dewatering means, to thereby obtain a portion of the dewatering.

4. The method according to claim 1, wherein said passing and providing steps comprise:

passing both the forming wire and the additional wire over at least one suction box and at least one foil, which both function as said dewatering means, to thereby obtain respective first and second portions of the dewatering.

* * * * *